United States Patent [19]

Harris et al.

[11] Patent Number: 4,661,079

[45] Date of Patent: Apr. 28, 1987

[54] IMAGE INTENSIFIER TUBE HAVING REDUCED VEILING GLARE

[75] Inventors: James W. Harris; Ronald A. Sink, both of Roanoke, Va.

[73] Assignee: ITT Corporation, New York, N.Y.

[21] Appl. No.: 749,049

[22] Filed: Jun. 26, 1985

[51] Int. Cl.[4] ..... H01J 43/22

[52] U.S. Cl. ..... 445/22; 65/43; 313/524

[58] Field of Search ..... 445/22; 65/43; 313/524

[56] References Cited

U.S. PATENT DOCUMENTS 3,253,896 5/1966 Woodcock et al. ..... 65/43
3,387,959 6/1968 Cole ..... 65/43 X
4,475,059 10/1984 Sink ..... 313/524

FOREIGN PATENT DOCUMENTS 2122808 1/1984 United Kingdom .

*Primary Examiner*—Kenneth J. Ramsey
*Attorney, Agent, or Firm*—John T. O'Halloran; Mary C. Werner

[57] ABSTRACT

An image intensifier tube and a method of making same are disclosed wherein veiling glare caused by the amplification of off-axis light is reduced. A face plate is formed from a fused assembly of a glass rod having a low reflective, light absorbing layer thereon, a cladding tube and a jacket tube. The fused assembly is then cut into wafer-shaped slices and the ends polished.

6 Claims, 5 Drawing Figures

IMAGE INTENSIFIER TUBE HAVING REDUCED VEILING GLARE

BACKGROUND OF THE INVENTION

This invention relates to image intensifier tubes of the type used in night vision viewing systems and, more particularly, to an image intensifier tube with reduced veiling glare and a method of making the same.

Image intensifier tubes multiply the amount of incident light they receive and thus provide an increase in light output which can be supplied either to a camera or directly to the eyes of a viewer. These devices are particularly useful for providing images from dark regions and have both industrial and military application. For example, these devices are used for enhancing the night vision of aviators, for photographing extraterrestial bodies; and for providing night vision to sufferers of retinitis pigmentosa (night blindness).

Modern image intensifier tubes utilize a microchannel plate (referred to as an MCP) which is a thin glass plate having an array of microscopic holes through it. Each hole is capable of acting as a channel-type secondary emission electron multiplier. When the microchannel plate is placed in the plane of an electron image in an intensifier tube, one can achieve a gain of up to several thousand and extremely high resolution. Since each channel in a microchannel plate operates nearly independently of all the others, a bright point source of light will saturate a few channels but will not spread out over adjacent areas. This characteristic of "local saturation" makes these tubes more immune to blooming at bright areas. However, these tubes suffer from a problem known as "veiling glare". Veiling glare is the result of scattered light falling on the light input or focal surface of the tube. In the image intensifier it results in a loss of contrast by filling in the darker portions of the image and decreasing the visibility of small or low contrast objects. In fact, in extreme cases it can cause a complete loss of picture information over a substantial part of the field of view.

Veiling glare is due primarily to off-axis light which is reflected into the inside of the tube and is intensified to appear in the field of view as unwanted images. The sources of veiling glare emanate from bright light rays which are outside the normal field of view; and hence, light rays which are at angles off the axis of view. The light rays emanating from sources outside normal field of view are reflected by the tube and cause the unwanted veiling glare.

There have been various attempts to eliminate or reduce the veiling glare by adding material to the tube which absorbs off-axis light and prevents it from being reflected to the inside of the tube. For example, black rings have been formed on the surface reflecting the off-axis light. These rings have been retained in place by sealing a glass ring to the surface or by fusing a glass ring to the surface to sandwich the ring in between the reflecting surface and the glass ring. This has been difficult to do and is very expensive. Another technique has been to etch a groove between the light input surface and the reflecting surface and to fill the groove with light absorbing material. This, too, has been difficult to do and is also very expensive.

U.S. Pat. No. 4,475,059 of R. A. Sink, "Image Intensifier Tube with Reduced Veiling Glare and Method of Making the Same", is directed to forming a colored, low reflective light absorbing layer in the face plate of the tube adjacent any surface at which off-axis light could be reflected to the photoemissive device. Another approach to reducing veiling glare is that described in co-pending patent application, Ser. No. 655,399, Filed Sept. 27, 1984 now abandoned in favor of continuation application Ser. No. 899,768, filed Aug. 22, 1986 to M. J. Drinkwine, entitled "Image Intensifier Tube with Reduced Veiling Glare and Method of Making the Same", wherein a surface of the face plate is formed with a non-reflective conductive coating. The present invention takes a different approach to this problem.

It is, therefore, an object of the present invention to provide a light image intensifier tube with reduced veiling glare which is economical to make. It is a further object of this invention to provide a method of making such a tube in a highly economical and efficient manner.

SUMMARY OF THE INVENTION

An image intensifier tube is formed with a face plate made of optical material for transmitting light and with photoemissive means for emitting electrons in response to the light transmitted therethrough. In making the tube, there is included the step of forming a face plate having a non-reflecting, light absorbing region which prevents off-axis light received at the region from being reflected to the photoemissive means. The method includes forming an assembly of a glass rod having a non-reflective, light absorbing material applied to its outer surface, a glass cladding tube and a glass jacket tube and heating the assembly under vacuum to collapse the tubes and fuse the rod and the tubes together.

The tube so formed includes the face plate arranged to receive and transmit input light; the photoemissive means for emitting the electrons; and a microchannel plate for amplifying the emitted electrons. The face plate also includes an assembly having a region where off-axis input light is prevented from being reflected to the photoemissive means.

BRIEF DESCRIPTION OF THE DRAWINGS

In order to obtain a better understanding of the invention, reference is made to the following detailed description of a preferred embodiment thereof, in which.

DETAILED DESCRIPTION OF THE INVENTION

Figures 1, 2:
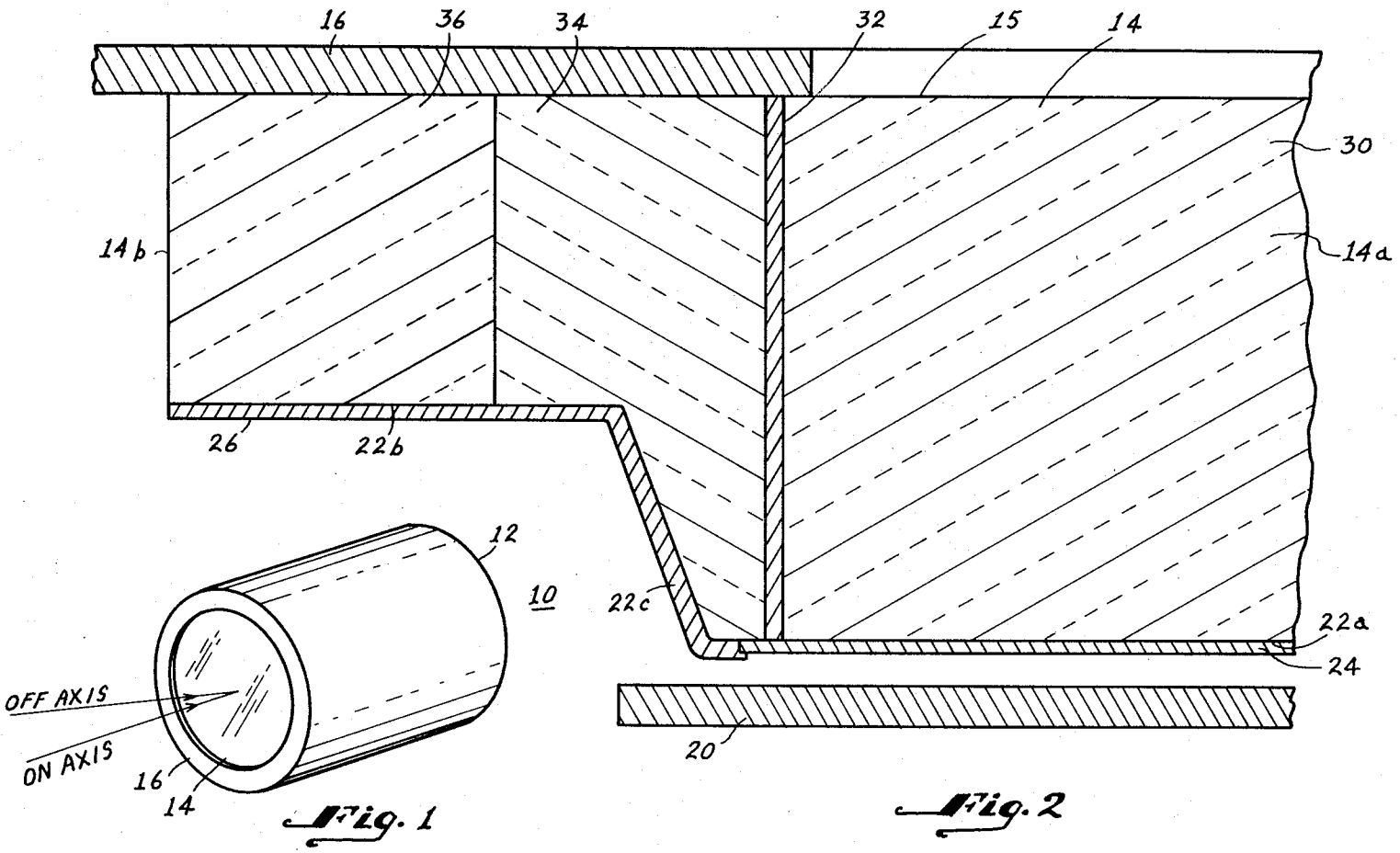
FIG. 1 is a perspective plan view of an image intensifier tube.
FIG. 2 is a cross-sectional view of a glass face plate produced in accordance with this invention.

In FIG. 1, there is shown a simplified perspective view of an image intensifier tube 10. The image intensifier tube 10 includes a cylindrical housing 12 in which is located a front face plate 14 made of optical material which is arranged to receive and transmit light. The face plate 14 is normally sealed within the housing 12 and is surrounded by a peripheral flange 16. Light rays from the field of view (labeled on axis in FIG. 1) penetrate the face plate 14 and are directed to the electronics of the image intensifier where they are increased in amplitude. Light rays which emanate from outside the field of view (labeled off axis in FIG. 1) are reflected off an inner surface of the tube 10 and are directed back to the electronics where they are also increased in amplitude. This off axis light is the source of the veiling glare, as will be made clear hereinafter.

In FIG. 2, the image intensifier tube 10 can be seen to comprise three basic components: the face plate 14 which functions as a cathode, a face plate (inside a chamber 18 and not illustrated in the drawing) which functions as an anode; and a microchannel plate 20 located in between and spaced from both the face plate 14 and the chamber 18. Both the cathode and anode face plates are preferably formed from glass of high optical quality. The formation of the cathode face plate of this invention is described hereinbelow.

The microchannel plate 20 is also formed of a glass material which possesses a secondary emissive property and conductive characteristics. The microchannel plate 20 is mounted in the image intensifier tube 10 with both its input and output faces parallel to a longitudinal axis of the image tube cathode face plate 14 and a phosphorous screen associated with the anode face plate. The microchannel plate 20 operates to amplify photo electrons generated by the input light in order to increase the light output of the tube.

Referring still to FIG. 2, in shape, the face plate 14 includes a central, generally circular body portion 14*a* and a reduced thickness sill portion 14*b* in the form of a flange surrounding the body portion. One surface 15 of the face plate 14 extends continuously across the body and sill portions 14*a* and 14*b*, respectively, and the portion of this surface extending over the sill portion 14*b* and a small adjacent portion of the central body portion 14*a* fits under the flange 16 and is secured thereto to retain the face plate in the housing 12. The remainder of the portion of surface 15, that is, that portion surrounded by the flange 16 is the exposed surface of the face plate 14 on which input light impinges.

The face plate 14 also includes surface portions 22*a* and 22*b* which are generally parallel to surface 15 and which extend over the body portion 14*a* and sill portion 14*b*, respectively. Because of the difference in thickness between the body portion 14*a* and the sill portion 14*b*, the surface portions 22*a* and 22*b* lie in different planes with the portion 22*a* being spaced farther from the surface 15 than is the portion 22*b*. Extending between the surface portions 22*a* and 22*b* is a connecting surface portion 22*c* which, in the embodiment disclosed herein, is generally frusto-conical.

As is usual in the art, surface portion 22*a* is applied with a photoemissive wafer 24 formed so that light impinging on the exposed portion of surface 15 and eventually striking the wafer 24 causes the emission of electrons. These electrons are accelerated across a gap by an electric field to the MCP 20 causing the secondary emission of electrons all in accordance with known principles. The usual photoemissive wafer is a suitable gallium arsenide (GaAs) device, but other suitable materials can be used. Connecting the photoemissive wafer 24 to an external biasing power supply (not shown) is a coating of conductive material 26 applied to the surfaces 22*b* and 22*c* and also over a portion of surface 22*a* so that this coating makes contact with the wafer 24. The most usual way of applying the coating 26 is to evaporate a metal, e.g., chromium, on these surfaces by conventional techniques.

In operation light rays traveling on the "on axis" which impinge on the exposed portion of surface 15 continue on to surface 24. However, light rays traveling on other axes which impinge on surface 15 also impinge on a surface of a rod 30 and are prevented from reaching the photoemissive wafer 24 since they are absorbed by a light absorbing layer 32 located on the rod 30.

Figure 3:
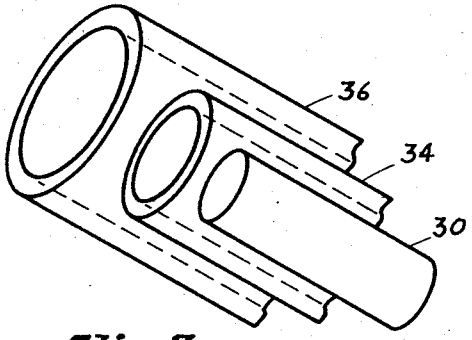
FIG. 3 is a perspective view of the face plate assembly of this invention.

FIG. 3 illustrates the basic assembly of the face plate 14. The rod 30 has the layer 32 of a low reflective, light absorbing material. A glass cladding tube 34 surrounds the outside of the layer 32. A glass vacuum jacket tube 36 surrounds the outide of the glass cladding tube 34. A description of a preferred method of this invention for assembling the components to form a face plate follows.

The glass rod 30 and the tubes 34 and 36 can be made of a clear, high quality optical glass such as Corning 7056. This glass comprises 70 percent silica ($S_iO_2$), 17 percent boric oxide ($B_2O_3$), 8 percent potash ($K_2O$), 3 percent alumina ($Al_2O_3$) and 1 percent each of soda ($Na_2O$) and lithium oxide ($Li_2O$). Other high quality optical glasses may, of course, be used.

The glass rod 30 has the layer 32 applied to its outer surface. The layer 32 includes either an amber glass stain, an enamel or a glass frit. The stain is applied and fired onto the outer surface of the glass rod 30. This fuses the stain into the glass and converts a layer of the clear optical glass into a colored, low reflective, light absorbing glass. The stain is such that it forms a metallic oxide in the glass that provides the coloration of the layer 32. A preferred metallic oxide layer is silver oxide (AgO) which can be formed from an amber stain including small amounts of silver. One example of such a stain is Amber Dip Stain No. 657 manufactured by American Ceramics Lab of Woodbridge, N.J. The rod 30 with the stain applied thereto is heated in an oven in an oxidizing atmosphere, e.g., air, to a temperature of between about 530° C. to about 590° C. This temperature is maintained for about six to seven hours.

The enamel and the glass frit may be any known high temperature material. Neither the enamel nor the glass frit need be fired onto the outer surface of the glass rod 30 prior to further processing.

After the layer 32 is applied to the rod 30, the glass tube 34 acting as a cladding is positioned around the outside of the rod 30 to which the layer 32 has been applied. The glass cladding tube 34 has an inside diameter which is slightly larger than the outside diameter of the rod 30 with the layer 32. The tube 34 adds radial dimension to the rod 30 so that the layer 32 will be properly positioned in the cylindrical housing 12.

The glass vacuum jacket tube 36 has an inside diameter which is slightly larger than the outside diameter of the tube 34 and is used to add radial dimension to the rod 30. The glass vacuum jacket tube 36 has one end which is closed. The rod 30 and the tube 34 are placed into the glass vacuum jacket tube 36 and are positioned against the closed end thereof.

The glass material of the rod 30 and the tubes 34 and 36 should have approximately the same softening temperature and the same coefficient of expansion so that distortions and breakage of these parts during heating and cooling is substantially eliminated.

The assembly of the rod 30, the cladding tube 34 and the jacket tube 36 is then inserted into a furnace equipped with a vacuum system. The vacuum system operates on the open end of the tube 36. The temperature in the furnace is slowly raised to the softening point of the glass. At this temperature the tube 36 becomes fused to the cladding tube 34 which in turn becomes fused to the rod 30 having the layer 32. The vacuum system aids in collapsing the glass tube assembly when the softening temperature of the materials is reached. In addition it helps eliminate moisture from the furnace so that defects are not formed at the interface between the rod 30 and the tubes 34 and 36. The fused assembly or boule is annealed and cooled and then removed from the furnace.

The ends of the boule are generally distorted and are therefore removed by means of a diamond saw. The outside surface of the boule is ground so that the boule will have a specific outside diameter to fit into the cylindrical housing 12. Individual face plates are made by slicing the boule into wafers.

The end surfaces of each of the wafers are polished to produce light receiving and light transmitting surfaces which are relatively smooth and free from distortion.

Figure 4:
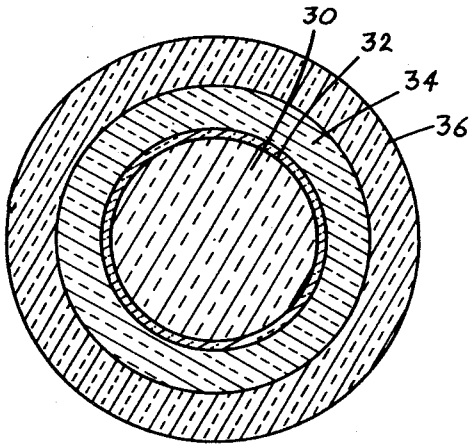
FIG. 4 is a cross-sectional view of the glass face plate of this invention.

The wafers are then cut into the configuration shown in FIG. 2 for mounting into the image intensifier tube 10. The cross-section of the face plate 14 taken through the sill portion **14*b* is shown in FIG. 4**.

Figure 5:
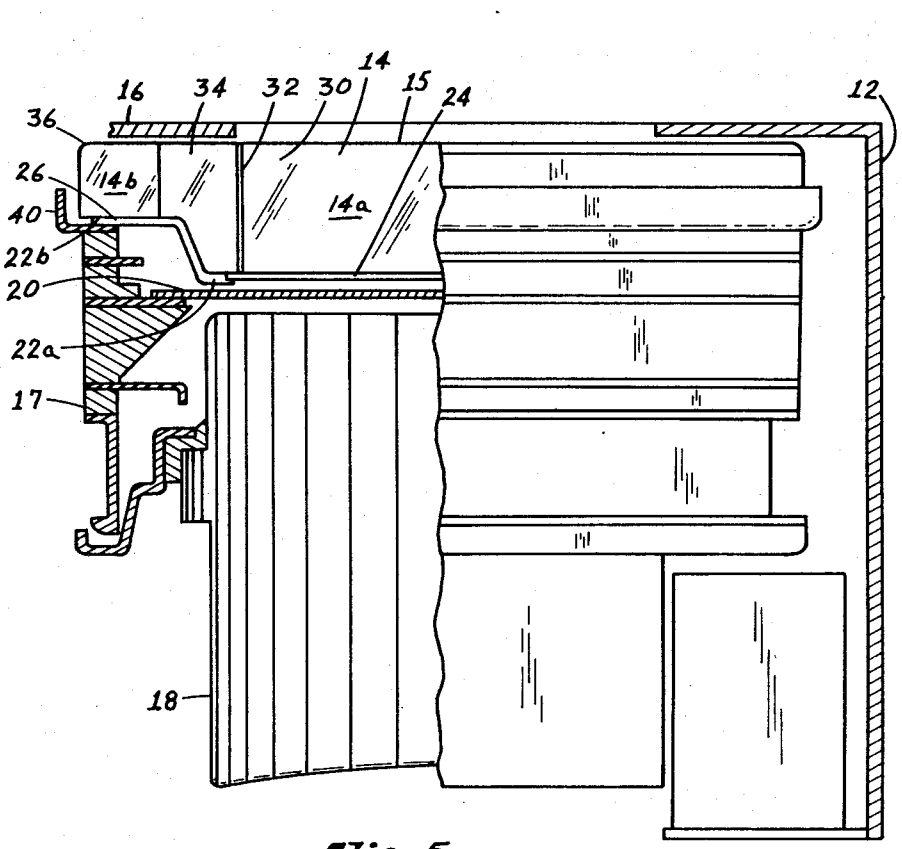
FIG. 5 is a partial cross-sectional view of a typical intensifier tube in accordance with this invention.

The image intensifier tube 10 is shown in greater detail in FIG. 5. As seen, the flange 16 is part of the cylindrical body 12 and the face plate 14 underlies the flange 16 and is supported at its ends by two "L" shaped members such as 40.

Located beneath the face plate 14 is the MCP plate 20. Both plates as 14 and 20 are sealed to the tube body 17 by means of conventional supporting structures. The chamber 18 contains the anode fiber optic face plate and the remaining structures forming the image intensifier tube.

While in the foregoing, there has been described a preferred embodiment of the invention, it should be understood that various changes and modifications can be made without departing from the true spirit and scope of the invention.

What is claimed is:

1. A method of making an image intensifier tube including a face plate made of optical material for transmitting light and photoemissive means associated with the face plate for emitting electrons in response to light transmitted through said face plate, the method comprising the steps of: 'depositing a layer of a low reflective, light absorbing material surrounding and in contact with the longitudinal outer surface of a glass rod;

positioning a glass cladding tube having a softening temperature substantially the same as the glass rod around the outer surface of the glass rod;

placing a glass vacuum jacket tube having a softening temperature substantially the same as the glass rod around the outer surface of the glass cladding tube to form an assembly; and heating the assembly to its softening temperature to collapse the assembly and fuse the rod, the cladding and the vacuum tube together.

2. The method according to claim 1 wherein said depositing step includes firing a stain onto the outer surface of the glass rod.

3. The method according to claim 1 wherein said depositing step includes applying an enamel material to the outer surface of the glass rod.

4. The method according to claim 1 wherein said depositing step includes applying a glass frit to the outer surface of the glass rod.

5. The method according to claim 1 wherein said depositing step includes coating the outer surface of the glass rod with a stain containing a metal element and heating the coated glass rod to fire the material into the glass rod.

6. The method according to claim 1 further comprising the steps of:

slicing the fused assembly cross sectionally to form a wafer-shaped face plate; and polishing the surfaces of the wafer to remove defects therefrom.

* * * * *